US005632422A

United States Patent [19]

Csengeri

[11] Patent Number: 5,632,422

[45] Date of Patent: May 27, 1997

[54] FOLDABLE GARMENT HANGER

[76] Inventor: Paul J. Csengeri, 5624 Calle De Arboles, Torrance, Calif. 90505

[21] Appl. No.: 566,079

[22] Filed: Dec. 1, 1995

[51] Int. Cl.[6] ..... A47G 25/14; A47G 25/40

[52] U.S. Cl. ..... 223/89; 223/94

[58] Field of Search ..... 223/85, 89, 94, 223/88, 92, 95; D6/315, 328

[56] References Cited

U.S. PATENT DOCUMENTS

| | | | |
|---|---|---|---|
| 1,184,743 | 5/1916 | Griffiths | 223/94 |
| 2,425,527 | 8/1947 | Gaudino | 223/94 |
| 3,430,827 | 3/1969 | Nelson | 223/89 |
| 4,997,115 | 3/1991 | Jolley | 223/94 |

*Primary Examiner*—Bibhu Mohanty
*Attorney, Agent, or Firm*—Dorothy S. Morse

[57] ABSTRACT

An improved triangular-shaped garment hanger having two legs of approximately equal length, a base member, and at least one pair of opposed flex points, one flex point of each pair located on the base member and its paired flex point located in an opposed position on one of the legs to allow it to temporarily fold into a nearly flat configuration for fast insertion into the neck opening, the flex points comprising flexible devices securely attached over the one of the legs and the base member, the flexible devices being attached to the leg and base member hanger frame by means such as adhesive or force fitting the flexible devices over ribs on the distal ends of one of the legs and the base member to obviate the need for a sleeve to hold the flexible devices in place, the garment hanger also having brackets positioned between each leg and the base member to add strength to the garment hanger configuration so that it can support heavy garments without sagging and drooping of a garment and for insertion without stretching the fabric of the garment which is adjacent to the neck opening. Applications may include, but are not limited to, use by clothing manufacturers, retail clothing stores, dry cleaners, uniform companies, and the general public.

1 Claim, 2 Drawing Sheets

FOLDABLE GARMENT HANGER

BACKGROUND—FIELD OF INVENTION

This invention relates to collapsible garment hangers, specifically to an improved triangular-shaped garment hanger having two legs of approximately equal length, a base member, and at least one pair of opposed flex points, one of the flex points located on the base member and its paired flex point located in an opposed position on one of the legs to allow the hanger to temporarily fold into a nearly flat configuration for fast insertion into the neck opening of a garment and for insertion without stretching the fabric of the garment which is adjacent to the neck opening, the flex points having sufficient size and dimension to fit over distal ends on the leg and the base member, the flex points also being securely attached to the leg and the base member by means such as adhesive or force fitting of the flex points over ribs on the distal ends on the leg and the base member, the garment hanger also having brackets positioned between the base member and each leg which add strength to the garment hanger configuration and prevent it from sagging and drooping during use. Applications may include, but are not limited to, use by clothing manufacturers, retail clothing stores, dry cleaners, uniform companies, and the general public.

BACKGROUND—DESCRIPTION OF PRIOR ART

A variety of collapsible hangers are known for hanging garments. Many collapsible hangers are configured with two arms which pivot around a centrally located component, such as a spindle. Examples of such devices are disclosed in U.S. Pat. No. 3,802,610 to Love (1974), U.S. Pat. No. 4,730,757 to Keller (1988), U.S. Pat. No. 4,524,890 to Fulton (1985), and U.S. Pat. No. 4,988,021 to Adams (1991). The Keller hanger is typical and discloses two arms connected at a pivoting point which rotate between an extended position and a downwardly collapsed position. U.S. Pat. No. 5,007,562 to Brink (1991) also discloses a hanger with two arms pivoting around a centrally located component. However, the Brink arms rotate upwardly, toward its suspending member, to achieve its collapsed position. The invention disclosed in U.S. Pat. No. 3,874,572 to McClenning (1975) also collapses around a central component, but, in addition, it has slidable arm extensions to adjust the overall size of the hanger invention to suit changing garment requirements. The present invention is distinguished from the above-mentioned inventions which pivot around a centrally located component, as the present invention has a triangular configuration instead of two arms attached to a centrally located component. Also, the above-mentioned inventions collapse by rotating around the central component, while the present invention folds with one leg coming toward its other leg to overlap it in a nearly flat configuration.

Collapsible garment hangers with a triangular shape similar to that of the present invention are disclosed in U.S. Pat. No. 3,703,378 to Sammartino (1972) and U.S. Pat. No. 5,044,534 to Hwang (1991). The Sammartino and Hwang hangers both have two side members of equal length, a suspending member at the intersection of the two side members, and a base member connected to each of the ends of the side members remote from the hook. Both the Sammartino and the Hwang hangers have a collapsing point centrally located on its base member and two additional collapsing points, each of which is located the intersection of the base member with one of the two side members. In contrast, the present invention has at least one pair of opposed flex points, so that the present invention collapses with one leg coming toward its other leg to overlap it in a nearly flat configuration.

The prior art known to be most closely related in operation to the present invention are disclosed in U.S. Pat. No. 3,719,312 to Krut (1973) U.S. Pat. No. 4,997,115 to Jolley (1991). The Krut collapsible hanger comprises two pieces of steel wire pivotally connected to each other by a rivet. The hook portion of the Krut hanger is located above the pivotal connection so that the over-all configuration is approximately that of an inverted "Y". By applying opposing forces to each of its free ends, the Krut hanger may be folded flat for insertion into a garment with a small neck opening. In spite of the fact that both the Krut invention and the present invention collapse with one leg coming toward its other leg to overlap it in a nearly flat configuration, there are many differences between the Krut and the present inventions. The Krut invention has two arms connected to each other by a rivet, while the present invention has an isosceles triangle configuration with two legs and a base member. Also, the Krut invention has a bending point around its rivet, while the present invention has at least one pair of flex points, one of which is located on its base member, with its paired flex point being located in an opposed position on one of its legs. The Krut hanger also requires two hands to collapse it. In contrast, the present invention allows the possibility of one-handed collapsing for even faster insertion into garments with small neck openings. The Jolley hanger comprises two arms and a cross member, one of the arms and the cross member having opposed separation points, with holes therein, into which springs are removably inserted. The Jolley hanger has a flexible sleeve which keeps the springs in place during use. The Jolley hanger can be folded at the separation points into a collapsed configuration for insertion into the neck of a garment, after which it automatically unfolds. It is not known to have an isosceles triangular-shaped garment hanger having two legs of equal length, a base member, and at least one pair of opposed flex points, one of the flex points located on the base member and the other paired flex point located in an opposed position on one of the legs to allow it to temporarily fold into a flat configuration for fast insertion into the neck opening the flex points having sufficient size and dimension to fit over distal ends on the leg and the base member, the flex points also being securely attached to the leg and the base member by means such as adhesive or force fitting of the flex points over ribs on the distal ends on the leg and the base member, the garment hanger also having brackets positioned between the base member and each leg which add strength to the garment hanger configuration and prevent it from sagging and drooping during use of a garment and for insertion without stretching the fabric of the garment which is adjacent to the neck opening.

SUMMARY OF INVENTION—OBJECTS AND ADVANTAGES

It is the primary object of this invention to provide a foldable hanger which may be inserted into the neck opening of a garment without stretching the fabric of the garment surrounding the neck opening and which supports the garment without sagging or drooping. It is also an object of this invention to provide a foldable hanger which may be inserted into garments with small neck openings. A further object of this invention is to provide a hanger which may be quickly and easily inserted into garments. It is also an object of this invention to provide a hanger which may be folded with one hand. A further object of this invention is to provide a hanger which automatically returns to its extended position after insertion into a garment. It is also an object of this invention to provide a hanger which is simple to use.

As described herein, properly manufactured and used, the present invention would provide a collapsible hanger that is simple to use. With one hand, a person could quickly fold one leg of the present invention over the other leg to form a nearly flat configuration for easy insertion into the neck opening in a garment, without stretching the fabric of the garment which is adjacent to the neck opening. Folding occurs at flex points which are which are securely attached to the hanger frame by means such as adhesive or force fitting flex points over fibs on the hanger frame. Brackets positioned between the base member and each leg add strength to the garment hanger configuration and prevent it from sagging and drooping during use. Since it folds nearly flat, the present invention may also be inserted into small neck openings without stretching fabric adjacent to the neck opening. Since the one-handed folding process is simple, the present invention may also be very easily removed from a garment, even one with a small neck opening. The ease of insertion into a garment is aided by the fact that the present invention automatically seeks its extended configuration when released within the garment. Since the present invention is also shaped like a conventional hanger, it may also be used to support other garments, such as a pair of pants.

The description herein provides preferred embodiments of the present invention but should not be construed as limiting the scope of the foldable garment hanger invention. Variations in the type of material used for the flexible devices creating the flex points, the type of material used for the hanger portion, the type of flexible devices used to create the flex points, the length of flexible devices used to create the flex points, the number and configuration of the brackets used to attach a second garment to the hanger, the thickness of the hanger portion, and the overall size of the present invention, other than those shown and described herein, can be incorporated into the present invention. Thus the scope of the present invention should be determined by the appended claims and their legal equivalents, rather than the examples given.

DETAILED DESCRIPTION OF PREFERRED EMBODIMENTS

Figure 1:
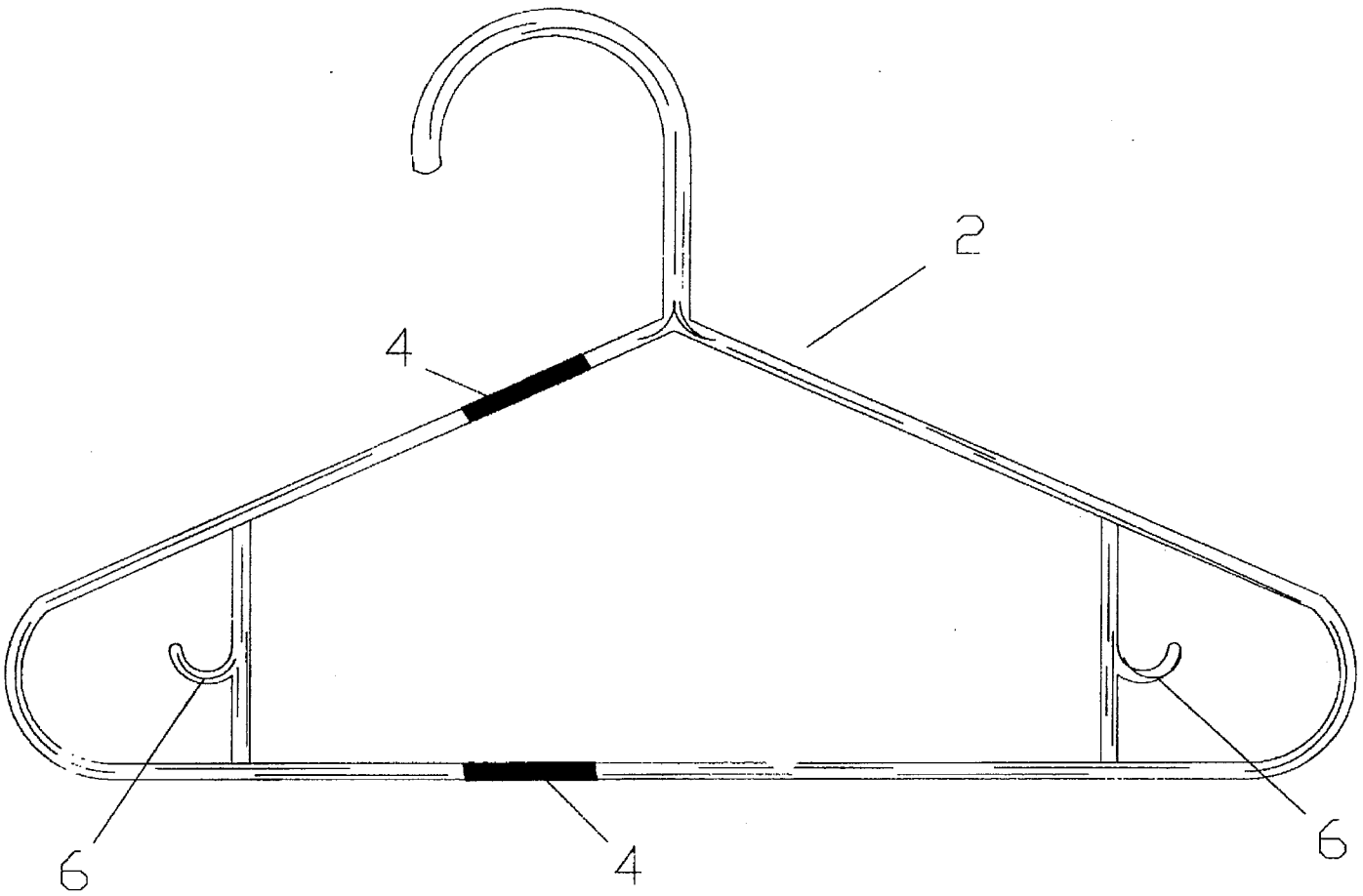
FIG. 1 is a perspective view of the invention in an extended position
Figure 2:
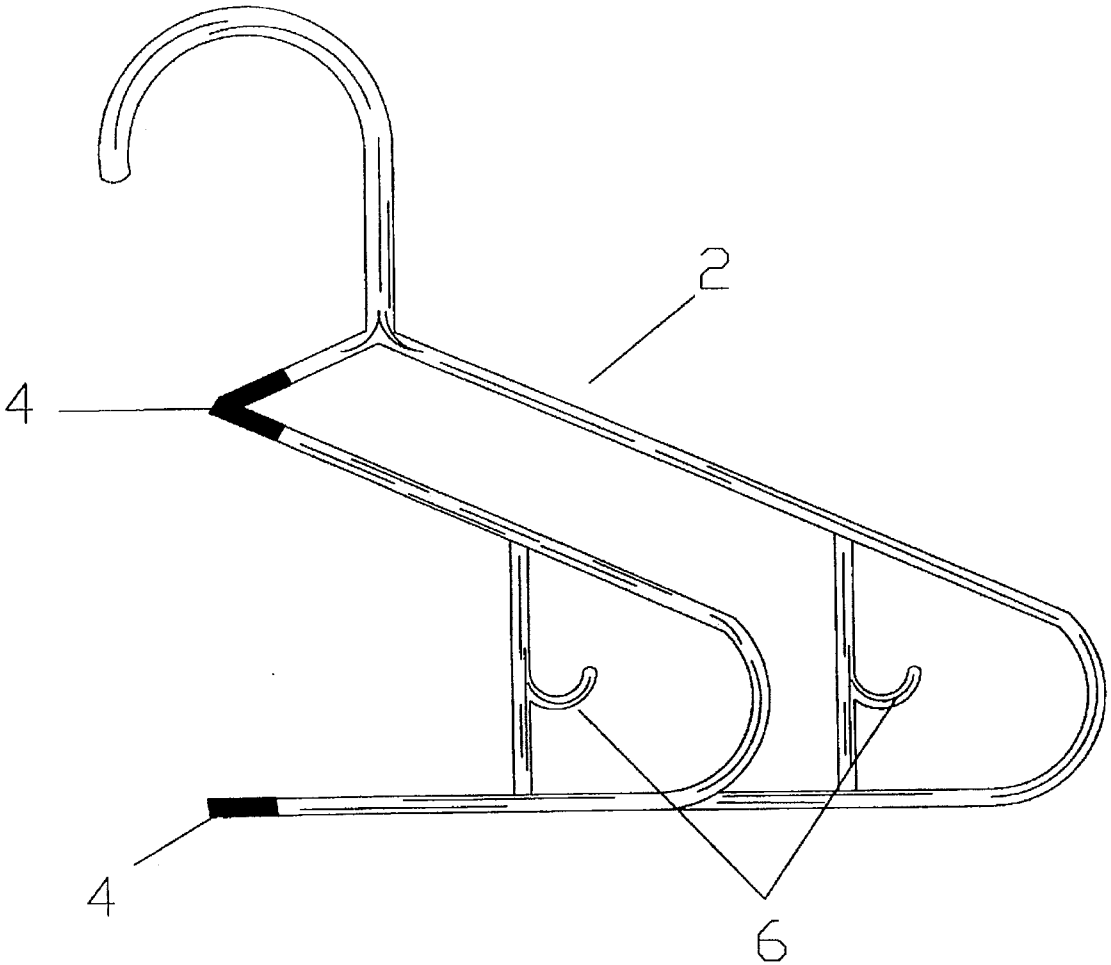
FIG. 2 is a perspective view of the invention in a folded position

FIGS. 1 and 2 show a preferred embodiment of the present invention having an isosceles triangular-shaped frame 2 with two legs of equal length attached to each other at one end and a base member attached to the opposite ends of each of the legs. It is not critical that the two legs of frame 2 be of equal length. When a flex point 4 is incorporated into a leg of frame 2, it is contemplated for it to be longer than, of equal length as, or shorter than the other leg of frame 2. It is also contemplated for frame 2 to have other configurations, as long as frame 2 has appropriate support means for the shoulders of a garment, once the hanger is fully extended within the garment. FIGS. 1 and 2 also show a pair of flex points 4 incorporated into frame 2 in opposed positions and two brackets 6 laterally positioned on frame 2 for attaching additional pieces of clothing to frame 2. In the preferred embodiment shown in FIGS. 1 and 2, one flex point 4 placed adjacent to the center of the base member of frame 2. The other flex point 4 is placed in a position opposed to its paired flex point 4 on one of the legs of frame 2. Although in FIGS. 1 and 2 flex points 4 are shown as metal springs, flex points 4 may also be made of, but not limited to, rubber springs, rubber strips, or hinges. Flex points 4 must be attached securely to frame 2 so that repeated flexing does not cause frame 2 to become separated from flex points 4. The means of attachment of flex points 4 to frame 2 is not critical to the present invention. However, in the preferred embodiment, flex points 4 are attached to frame 2 by adhesive means or by force fitting flex points over ribs (not shown) on portions of frame 2 adjacent to flex points 4. Also, the material from which frame 2 is made is not critical to the present invention. Frame 2 may be made of, but not limited to, plastic, metal, wood, composites, or a hard rubber. In the preferred embodiment, frame 2 is made of plastic.

Although shown in FIGS. 1 and 2, brackets 6 are not critical to the present invention, but since brackets 6 are shown providing rigid connection between the base member and each leg, brackets 6 would add to the structural integrity of the present invention. Brackets 6 may have configurations different from, and may be placed in positions on frame 2 other than, that shown in FIGS. 1 and 2. For example, brackets 6 may depend downward from the base member of frame 2, instead of being positioned between lateral portions of the base member of frame 2 and each leg of frame 2. Also, brackets 6 may be made out of the same material used for triangular-shaped frame 2, or from a different material. In the preferred embodiment, brackets 6 are made from the same material used to make frame 2.

To use the present invention, a person may fold frame 2 with one or two hands. In using one hand, the index finger is positioned on the portion of frame 2 which will be on the inside of the fold, while the remaining fingers and thumb are positioned on the opposite side of frame 2. As the thumb applies pressure to frame 2, the fingers support frame 2 and allow flex points 4 to bend, causing the lateral portions of the present invention to bend toward one another. In its collapsed position, the present invention may be inserted into the neck opening of a garment. Upon releasing the fingers and thumb, the present invention automatically returns to its fully extended configuration within the garment. To remove the present invention from the garment, the present invention is folded while within the garment, then rotated to remove it from the garment. Once removed from the garment and once the fingers and thumb release their grip on frame 2, the present invention automatically returns to its fully extended position.

What is claimed is:

1. An improvement for a prior art foldable garment hanger having a triangular shape with two elongated legs each having opposite ends, one of said opposite ends of each of said legs being connected to a hooking member and each of said legs being connected at the other of said opposite ends to an opposed end of an elongated base member, said prior art foldable garment hanger also having flex points comprising a first flexible device located between two segments of one of said legs and connected to each of said leg segments, and a second flexible device located between two segments of said base member at a point immediately below said first flexible device and connected to each of said base member segments, said leg segments and said base member segments each having a distal end and a connection hole axially positioned within said distal end, said first flexible device being removably inserted into said connection holes in said leg segments, and said second flexible device being removably inserted into said connection holes in said base member segments, said prior art foldable garment hanger also comprising a flexible sleeve overlaying said legs, said first flexible device, said base member, and said second flexible device so as to prevent said first flexible device and said second flexible device from separating from said connection holes during use, wherein said improvement comprises:

said first flexible device having sufficient size and dimension to fit over said distal ends of said leg segments and said second flexible device comprising sufficient size and dimension to fit over said distal ends of said base member segments thereby obviating the need for connection of said first flexible device to said leg segments and said second flexible device to said base member segments by use of said connection holes, and also obviating the need for said flexible sleeve which can restrict function of said first flexible device and said second flexible device thereby making said improved foldable garment hanger easier to use than said prior art foldable garment hanger and allowing said improved garment hanger to support heavier garments since said first flexible device and said second flexible device which fit over said distal ends are larger than said prior art first flexible device and said second prior art flexible device which fit into said connection holes;

said improvement also comprising at least two brackets made from rigid material, one of said brackets positioned between said base member and each of said legs to add structural integrity to said flexible hanger and prevent said base member and said legs from sagging and drooping during use, further enhancing the ability of said improved foldable garment hanger to hold heavy garments; and said improvement further comprising means to secure said first flexible device to said leg segments and said second flexible device to said base member segments, said means to secure comprising a plurality of ribs on said distal ends of said leg segments and said base member segments sufficient to bind said first flexible device to said distal ends of said leg segment and said second flexible device to said distal ends of said base member segment so that said first flexible device of said improved foldable hanger and said second flexible device of said improved foldable hanger will not separate from said leg segments and said base member segments during use and so that said improved foldable hanger is simpler to manufacture than said prior art foldable hangers, less complex to use, and said first flexible device and said second flexible device of said improved foldable hanger are exposed to view so that the folding function of said improved folding hanger is quickly recognizable to a user.

* * * * *